US007070264B2

(12) United States Patent
Ikeda

(10) Patent No.: US 7,070,264 B2
(45) Date of Patent: Jul. 4, 2006

(54) INK JET RECORDING APPARATUS

(75) Inventor: Takahisa Ikeda, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 189 days.

(21) Appl. No.: 10/689,817

(22) Filed: Oct. 20, 2003

(65) Prior Publication Data

US 2004/0100541 A1 May 27, 2004

(30) Foreign Application Priority Data

Nov. 26, 2002 (JP) ..... 2002-341898

(51) Int. Cl.
*B41J 2/175* (2006.01)

(52) U.S. Cl. ..... 347/85

(58) Field of Classification Search ..... 347/85, 347/86, 87, 92

See application file for complete search history.

(56) References Cited

U.S. PATENT DOCUMENTS 4,489,334 A * 12/1984 Owatari ..... 347/92
5,341,162 A 8/1994 Hermanson et al.
5,910,810 A * 6/1999 Brooks et al. ..... 347/88
6,059,405 A * 5/2000 Mochizuki et al. ..... 347/92
6,213,596 B1 * 4/2001 Nowell et al. ..... 347/85
6,557,990 B1 * 5/2003 Altendorf ..... 347/92
2002/0027585 A1 3/2002 Oda et al.
2002/0158950 A1 10/2002 Altendorf

FOREIGN PATENT DOCUMENTS

JP 63-145039 A 6/1988
JP 11-042771 A 2/1999
JP 11-48493 A 2/1999

* cited by examiner

*Primary Examiner*—Anh T. N. Vo
(74) *Attorney, Agent, or Firm*—Frishauf, Holtz, Goodman & Chick, P.C.

(57) ABSTRACT

An ink jet recording apparatus having an ink jet head to discharge supplied ink from a nozzle, a deaeration device to deaerate dissolved gas from the ink supplied to the ink jet head, an ink reservoir, provided in an ink channel between the deaeration device and the ink jet head, to apply negative pressure by a difference in level of the ink reservoir surface and the nozzle, and a preventative member, floated on the surface of ink in the ink reservoir, to prevent contact between the ink and air. Even when the ink, from which dissolved gas has been deaerated by the deaeration device, is stored in the ink reservoir in a course of supplying process of the ink, re-dissolution of gas in the ink in the ink reservoir can be suppressed. Further, the ink can be reliably pressurized in the ink jet head, and ink droplets can be excellently discharged from the nozzle.

3 Claims, 2 Drawing Sheets

INK JET RECORDING APPARATUS

BACKGROUND OF THE INVENTION

CROSS REFERENCE OF THE RELATED APPLICATION

This application is based upon and claims the benefit of priority from the prior Japanese Application No. 2002-341898, filed on Nov. 26, 2002, the entire contents of which are incorporated herein by reference.

1. Field of the Invention

The present invention relates to an ink jet recording apparatus which performs image formation by discharging ink droplets.

2. Discussion of the Background

Conventionally, in an ink jet recording apparatus, ink in a pressure chamber is pressurized thereby the ink is discharged as ink droplets, and the discharged ink droplets are attached to a recording medium, thus image formation is made.

If the ink includes air bubbles, the pressurization force to the ink in the pressure chamber is absorbed by the compressible air bubbles and the performance of ink droplet discharge is degraded. The air bubbles are caused from dissolved gas in the ink. The phenomenon that the dissolved gas in the ink becomes air bubbles due to high-frequency vibration by pressure generation means is known as cavitation. Accordingly, it is necessary to remove dissolved gas from ink supplied to an ink jet head, and various deaeration devices to remove the dissolved gas from the ink have been proposed (See, e.g., Japanese Published Unexamined Patent Application Nos. Hei 11-42771 and Hei 11-48493).

Further, in the ink jet recording apparatus, it is preferable that the ink in a nozzle is controlled to a negative-pressure applied state for prevention of ink leakage from the nozzle. For this purpose, proposed is an arrangement where ink reservoir to store ink is provided between the deaeration device and the ink jet head and negative pressure is applied to the ink in the nozzle utilizing a difference in level of the ink reservoir surface and the nozzle.

However, in a case where the ink from which the dissolved gas has been once deaerated by the deaeration device is stored in the ink reservoir, the ink, in contact with air upon utilization of difference in level of the ink reservoir surface and the nozzle, receives atmospheric pressure. While the ink is stored in the ink reservoir, re-dissolution of gas in the ink easily occurs.

SUMMARY OF THE INVENTION

Accordingly, an object of the present invention is, in a case where ink from which dissolved gas has been deaerated by a deaeration device is temporarily stored in an ink reservoir and negative pressure is applied to the ink in a nozzle by utilizing a difference in level of the ink reservoir surface and the nozzle, to prevent re-dissolution of the gas in the ink stored in the ink reservoir.

The above object of the present invention is attained by providing a novel ink jet recording apparatus of the present invention.

The novel ink jet recording apparatus according to the present invention comprises: an ink jet head that discharges supplied ink from a nozzle; a deaeration device that deaerates dissolved gas from the ink supplied to the ink jet head; an ink reservoir that is provided in an ink channel between the deaeration device and the ink jet head and applies negative pressure by a difference in level of the ink reservoir surface and the nozzle; and a preventative member that is floated on the surface of ink in the ink reservoir and prevents contact between the ink and air.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
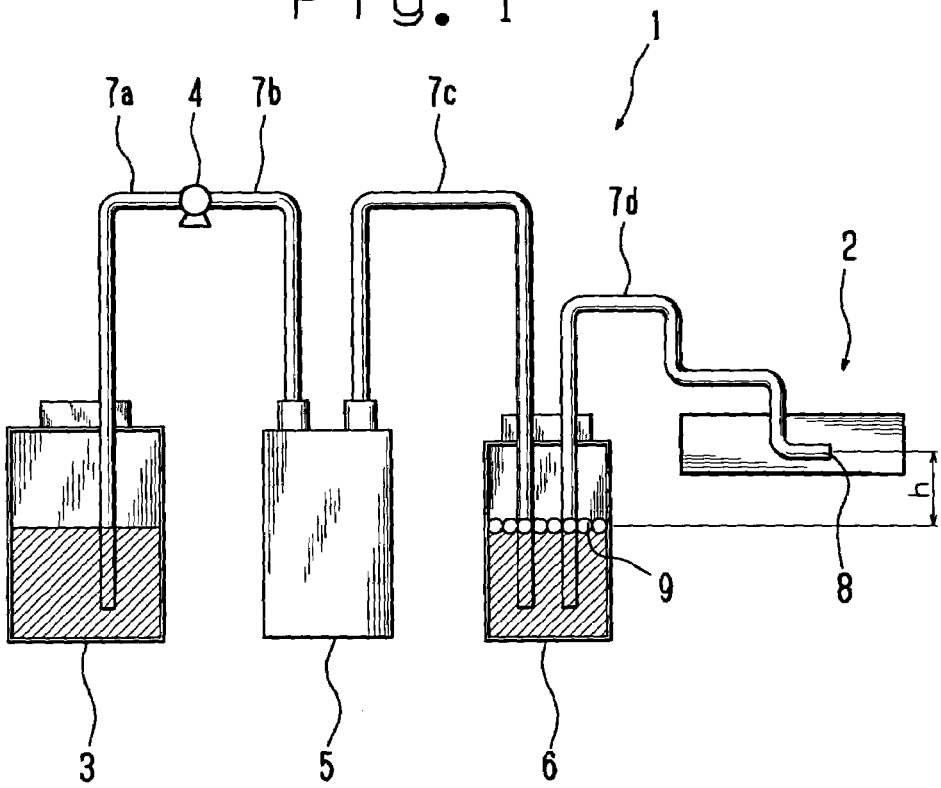
FIG. 1 is an explanatory view of an ink channel in an ink jet recording apparatus according to a first embodiment of the present invention.

A first embodiment of the present invention will be described with reference to FIGS. 1 and 2. FIG. 1 is an explanatory view of an ink channel in an ink jet recording apparatus 1 according to the present embodiment.

The ink jet recording apparatus 1 has an ink jet head 2, an ink tank 3, a liquid feed pump 4, a deaeration device 5, and an ink reservoir 6. These elements are connected with ink pipes 7*a* to 7*d*.

The ink tank 3 is a portion where ink supplied to the ink jet head 2 is stored. The ink in the ink tank 3 is supplied by driving of the liquid feed pump 4 via the deaeration device 5 and the ink reservoir 6 to the ink jet head 2. The ink used in the apparatus is liquid type ink such as water-based ink, oil-based ink or ultraviolet-curing ink. Coloring material such as pigment or dye stuff is employed.

The deaeration device 5, as a portion to deaerate dissolved gas from the ink, has a heater (not shown) to heat ink, a suction pump (not shown) to suck deaerated dissolved gas, and the like.

The ink reservoir 6 is a portion where the deaerated ink by the deaeration device 5 is temporarily stored. Utilizing a difference "h" in level of the ink reservoir 6 surface and the nozzle 8 provided in the ink jet head 2, negative pressure is applied to ink in the nozzle 8. The operation of the applied negative pressure prevents leakage of ink from the nozzle 8.

In the ink reservoir 6, plural plastic balls 9, as preventative members to prevent contact between the ink and the air, float on the ink surface. The plastic ball 9 is formed with ink-proof material, and further, it is formed in a ball shape.

Figure 2:
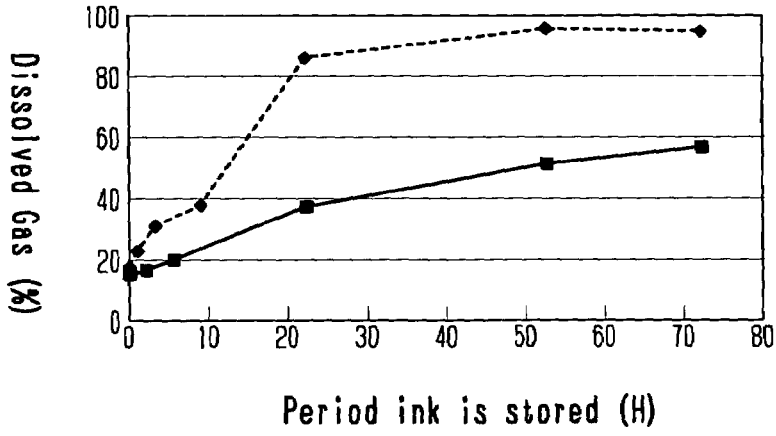
FIG. 2 is a graph showing re-dissolution of gas in ink in a case where plastic balls as preventative members are provided in an ink reservoir and in a case where the plastic balls are not provided.

In this construction, the change of amount of dissolved gas in the once-deaerated ink stored in the ink reservoir 6 is shown in the graph of FIG. 2. FIG. 2 shows re-dissolution of gas in ink in a case where the plastic balls 9 as preventative members are provided in the ink reservoir and in a case where the plastic balls are not provided. Note that in FIG. 2, a solid line indicates the case where the plastic balls 9 are provided in the ink reservoir 6, and a broken line, the case where the plastic balls 9 are not provided.

As shown in this graph, by preventing contact between the ink surface in the ink reservoir 6 and the air with the plastic balls 9, the re-dissolution of gas in the ink in the ink reservoir 6 can be suppressed, and increment in the amount of dissolved gas in the ink can be suppressed.

In the case where the amount of dissolved gas in the ink supplied from the ink reservoir 6 to the ink jet head 2 can be reduced by providing the plastic balls 9 in the ink reservoir 6 and the ink is pressurized by pressure generation means such as a piezo-electric member in the ink jet head 2, the ink can be reliably pressurized, and ink droplets can be excellently discharged from the nozzle 8.

Further, as the preventative members are plural balls, it is not necessary to form the preventative member in correspondence with the inner shape of the ink reservoir 6, and the cost can be reduced.

Figure 3:
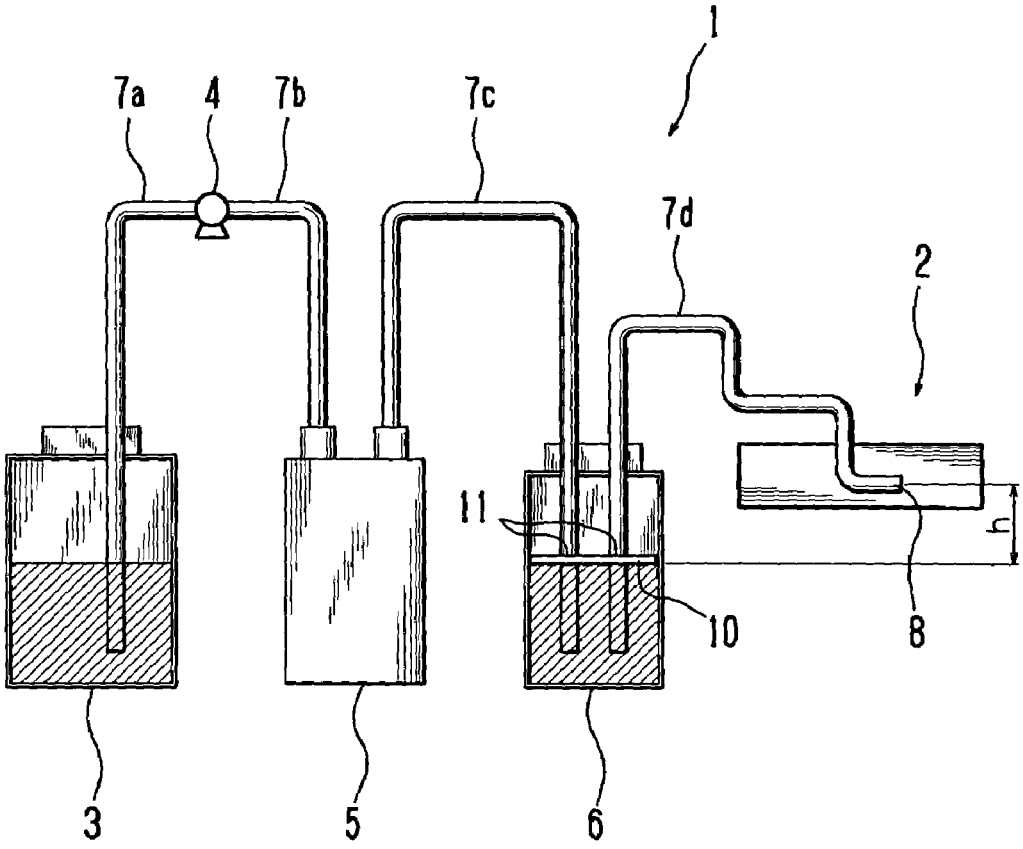
FIG. 3 is an explanatory view of the ink channel in the ink jet recording apparatus according to a second embodiment of the present invention.

Next, a second embodiment of the present invention will be described with reference to FIG. 3. FIG. 3 is an explanatory view of the ink channel in the ink jet recording apparatus 1 according to the second embodiment. Note that in FIG. 3, elements corresponding to those described in FIGS. 1 and 2 have the same reference numerals and explanations thereof will be omitted.

In the present embodiment, a disk plate 10 as a preventative member is provided in place of the plastic balls 9 in the ink reservoir 6. The other constituent elements are the same as those of the first embodiment.

The disk plate 10, formed with ink-proof material having a lighter specific gravity than that of ink, floats on the ink surface, and the disk plate has a through hole 11 through which ink pipes 7*c* and 7*d* are inserted in its central portion.

Also in the present embodiment, contact between the ink surface in the ink reservoir 6 and the air can be prevented by the disk plate 10, and re-dissolution of gas in the ink in the ink reservoir 6 can be suppressed, and increment in the amount of dissolved gas in the ink can be suppressed. Accordingly, when the ink is pressurized by the pressure generation means such as a piezo-electric member in the ink jet heat 2, the ink can be reliably pressurized, and ink droplets can be excellently discharged from the nozzle 8.

Further, as the preventative member is a plate, the ink surface in the ink reservoir 6 can be easily and reliably covered with the plate. As a result, contact between the ink in the ink reservoir 6 and the air can be easily and reliably prevented.

According to the present invention, as described in the first and second embodiments, the preventative members 9 and 10 to prevent contact between the ink and the air are floated on the ink surface in the ink reservoir 6, provided in the ink channels 7*c* and 7*d* between and the ink jet head 2 and the deaeration device 5 to deaerate dissolved gas from the ink supplied to the ink jet head 2. Even when the ink, from which the dissolved gas has been deaerated by the deaeration device 5 is stored in the ink reservoir 6 in a course of supplying process of the ink, re-dissolution of gas in the ink in the ink reservoir 6 can be suppressed. Thus the ink can be reliably pressurized in the ink jet head 2 upon pressurizing of the ink, and ink droplets can be excellently discharged from the nozzle 8.

Obviously, numerous modifications and variations of the present invention are possible in light of the above teachings. It is therefore to be understood that within the scope of appended claims, the invention may be practiced otherwise than as specifically described herein.

What is claimed is:

1. An ink jet recording apparatus, comprising:

an ink jet head that discharges supplied ink from a nozzle;

a deaeration device that deaerates dissolved gas from the ink supplied to the ink jet head;

an ink reservoir that is provided in an ink channel between the deaeration device and the ink jet head, wherein a level of a surface of the ink in the ink reservoir is different from a level of the nozzle such that negative pressure is applied to the ink in the nozzle; and a preventative member that floats on the surface of the ink in the ink reservoir and prevents contact between the ink and air.

2. The ink jet recording apparatus according to claim 1, wherein the preventative member comprises a plurality of balls.

3. The ink jet recording apparatus according to claim 1, wherein the preventative member comprises a plate.

* * * * *